US007229525B2

(12) United States Patent
Duggirala et al.

(10) Patent No.: US 7,229,525 B2
(45) Date of Patent: Jun. 12, 2007

(54) METHODS TO ENHANCE PULP BLEACHING AND DELIGNIFICATION

(75) Inventors: Prasad Y. Duggirala, Naperville, IL (US); Sergey M. Shevchenko, Aurora, IL (US); Kristine S. Salmen, Naperville, IL (US)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 11/121,217

(22) Filed: May 3, 2005

(65) Prior Publication Data

US 2005/0194111 A1 Sep. 8, 2005

Related U.S. Application Data

(60) Continuation of application No. 10/774,278, filed on Feb. 6, 2004, now abandoned, which is a division of application No. 09/846,635, filed on May 1, 2001, now Pat. No. 6,702,921.

(51) Int. Cl.
*D21B 1/16* (2006.01)

(52) U.S. Cl. ..... 162/24; 162/17; 162/25; 162/82

(58) Field of Classification Search ..... 162/82, 162/24, 25, 26, 70, 71, 72, 76
See application file for complete search history.

(56) References Cited

U.S. PATENT DOCUMENTS 4,578,148 A * 3/1986 Lindahl ..... 162/26
4,599,138 A * 7/1986 Lindahl ..... 162/19
5,164,095 A * 11/1992 Sparapany et al. ..... 210/735
5,328,599 A * 7/1994 Siefert et al. ..... 210/96.1
5,346,627 A * 9/1994 Siefert et al. ..... 210/729
5,401,420 A * 3/1995 Siefert et al. ..... 210/709
6,030,495 A * 2/2000 Wan et al. ..... 162/82
6,242,245 B1 * 6/2001 Amann et al. ..... 435/277
6,254,724 B1 * 7/2001 Seltzer et al. ..... 162/70
6,267,844 B1 * 7/2001 Jackson ..... 162/164.5

FOREIGN PATENT DOCUMENTS

CA 1174810 A * 9/1984
CA 1193053 A * 9/1985
JP 05302288 A * 11/1993

* cited by examiner

*Primary Examiner*—Eric Hug
*Assistant Examiner*—John B. Edel
(74) *Attorney, Agent, or Firm*—Peter A. DiMattia; Michael B. Martin; Thomas M. Breininger

(57) ABSTRACT

A method to enhance brightness in Chemical and Mechanical pulps comprising adding an organic sulfide chelant is described and claimed.

A method to enhance delignification in a Chemical pulp comprising adding an organic sulfide chelant is also described and claimed.

4 Claims, No Drawings

METHODS TO ENHANCE PULP BLEACHING AND DELIGNIFICATION

CROSS REFERENCE TO RELATED APPLICATIONS

This application is a continuation application of Ser. No. 10/774,278 filed Feb. 6, 2004 now abandoned which is a divisional application of Ser. No. 09/846,635 filed May 1, 2001 now U.S. Pat. No. 6,702,921.

FIELD OF THE INVENTION

This invention relates generally to pulp and paper making, and more particularly to the bleaching and delignification of pulp.

BACKGROUND OF THE INVENTION

There are three major types of pulping methods known in the Pulp and Paper Industry. The first is Chemical and the second is Mechanical and the third is a Combination of Chemical and Mechanical. Methods to enhance the effectiveness of all three types of pulping methods are always desirable.

In Chemical pulps, sufficient lignin is dissolved to allow the fibers to separate with little, if any mechanical action. However, a portion of the lignin remains with the fiber and an attempt to remove this during digestion would result in excess degradation of the pulp. The degradation is a depolymerization of the cellulose and is measured by determining the viscosity of the cellulose dissolved in special solvents. For this reason from about 3 wt. % lignin to about 4 wt. % lignin is normally left in hardwood chemical pulps and from about 4 wt. % to about 10 wt. % lignin is normally left in softwood chemical pulps after the cook or digestion. The lignin is subsequently removed by bleaching in separate pulp mill operations if completely delignified and whitened pulps are to be produced.

The dominant Chemical wood pulping process is the kraft ("kraft" means strength in German) or sulfate process. In the kraft process, the alkaline pulping liquor or digesting solution contains about a 3 to 1 ratio of sodium hydroxide and sodium sulfide. A stronger pulp is obtained when sodium sulfide is used in combination with sodium hydroxide. This is to be compared with pulp obtained when sodium hydroxide is used alone, as it was in the original soda process. In the kraft process the wood is delignified (pulped) with a solution of sodium hydroxide and the addition of sodium sulfide is beneficial for pulping as well. Key advantages of the kraft process is its great adaptability of pulping many different species of wood and yielding pulps that may be used for a variety of applications.

Another type of Chemical pulping is the "sulfite process". The sulfite process has several advantages over the kraft process. These advantages include improved yield (45-55%), lower cost cooking chemicals, higher brightness pulps and more easily bleached pulps. However, the sulfite method also has two distinct disadvantages: only a limited number of species can be pulped and the pulps produced are distinctly weaker than those made using the kraft or sulfate process.

In Mechanical pulping, pulp is made predominantly using mechanical methods. The fundamental criterion used in assessing the quality of mechanical pulp is the amount of energy expended per unit of production. Because this energy is difficult to quantify, pulp freeness is most commonly used as a process control parameter. Generally, the more the energy expenditure the lower the freeness of the pulp.

The first step in the Mechanical pulping process is the grinding or refining of wood.

The Stone Groundwood (SGW) process involves making pulp by pressing logs and chips against an abrasive rotating surface. Many years ago the grinding surface used was an actual stone. In current practice specifically designed "artificial pulp stones" are available for the grinding.

A Pressurized GroundWood (PGW) process is where the grinding operation is completely pressurized.

Another type of Mechanical pulping is Refiner Mechanical Pulp (RMP) featuring atmospheric refining with no pretreatment of the wood chips. This process is one of the main mechanical pulping operations.

Thermo Mechanical Pulping (TMP) is a Mechanical pulping process that evolved from RMP and a high temperature process known as the Apslund process. Thermo Refiner Mechanical Pulping (TRMP) is a variation in Thermo Mechanical Pulping. In this case, the chips are preheated under pressure and refining is carried out at atmospheric pressure. TMP and TRMP pulps are stronger than either SCW or RMP pulps.

The third type of pulping process is a Combination of Chemical and Mechanical pulping processes. Two types of Combination processes are ChemiMechanical Pulping and SemiMechanical Pulping. There is little difference between ChemiMechanical Pulping (CMP) and SemiChemical Mechanical Pulping (SCMP). Both processes involve pretreatment of chips with chemicals, followed by mechanical refining. Four different chemical treatments are associated with these processes. These chemical treatments are: sodium hydroxide, sodium bisulfite, sodium sulfite, acid sulfite treatment. These processes are generally used on hardwoods. Chemical treatment weakens the fiber structure allowing fibers to rupture similarly to softwood that is mechanically pulped.

ChemiThermoMechanical Pulping (CTMP) appears to be a full evolution of all Mechanical pulping methods. It includes chemical treatment elevated temperature steaming followed by mechanical refining. This process can produce fibrous raw materials that vary considerably in properties depending upon process conditions such as sodium sulfite concentration, pH, temperature, etc.

With all pulps, "pulp brightness" is a measurement of the ability of a sample to reflect monochromatic (457 nm) light as compared to a known standard, using magnesium oxide (MgO). Since cellulose and hemicellulose are white, they do not contribute to pulp color. It is generally agreed that the lignin left in the pulp after pulping is responsible for the color the pulp. This unbleached pulp has an appearance similar to brown grocery bags. The chromophores are believed to be quinone-like materials formed from the lignin's phenolic groups through an oxidative mechanism. Additionally, heavy metal ions, especially iron and copper, can form colored complexes with the phenolic groups.

There are generally two approaches to removing color. The first uses a selective chemical to destroy the chromophores but not the lignin. The other approach is to use a bleaching system to remove the residual lignin. The bleaching of pulp is the standard method of removing color from pulp. It is current state of the art technology for all Chemical and Mechanical pulps to be bleached.

The bleaching of pulp and the subsequent delignification of pulp is usually performed in several stages, with each stage being referred to by a letter designation. Note, that although all pulps are bleached, only Chemical pulps are delignified using oxygen treatment.

The following table briefly describes the most common stages in a "typical" bleaching process. Note that the stages captured in this table are not necessarily in the order that they are practiced. For example, oxygen delignification is typically never the last step in the process as oxygen delignification leaves the pulp yellowish in color. That is why oxygen delignification is followed by some level of bleaching.

| Stage | Description |
|---|---|
| C-chlorination | Reaction with $Cl_2$ in an acidic medium |
| E-Extraction or $E_O$ or $E_{OP}$ | Dissolution of chlorination reaction products with sodium hydroxide adding oxygen with the sodium hydroxide to improve delignifiication and lower the use of chlorine and chlorine dioxide adding oxygen and peroxide with the sodium hydroxide to improve delignification and lower the use of chlorine and chlorine dioxide |
| H-Hypochlorite | Reaction with sodium hypochlorite in alkaline medium |
| D-Chlorine Dioxide | Reaction with $ClO_2$ in an acidic medium |
| P-Peroxide | Reaction with peroxides in an alkaline medium |
| O-Oxygen | Reaction with $O_2$ at high pressure in an alkaline medium. Usually used prior to chlorine as a delignification step. |
| $D_C$ or $C_D$ | Mixture of chlorine and chlorine dioxide |

Usually the chlorination and extraction stages are carried out in sequence, first chlorinating the lignin compounds and then solubilizing them in the alkaline extraction stage. This is similar to the oxygen stage in that the objective is exclusively to delignify the pulp.

Five or six stages are needed to produce a "full bleach" brightness level of 89 to 91% MgO. Most commonly these stages, in order are CEDED, CEHDED and OCEDED. A brightness of 65% MgO can be obtained with less stages, usually a CEH. Intermediate brightness levels can be reached using CED, CEHH, CEHD, or CEHP. Brightness enhancement during bleaching of pulp, as well as improving selective lignin removal during oxygen delignification of the chemical (kraft) pulp is important in the pulp and paper industry. Brightness enhancement is also useful in Mechanical pulps.

It is to be understood that separate from the technical aspects of bleaching pulp there are environmental concerns that have dictated that chlorination is being rapidly reduced or eliminated in favor of alternative treatments.

In current practice in pulp and paper mills, Mechanical pulps are not oxygen delignified.

Currently, hydrogen peroxide is the dominant bleaching agent for mechanical pulps. Sodium hydrosulfite can also be used for bleaching. Several auxiliary chemicals are needed to provide an adequate performance. These auxiliary chemicals include sodium silicate for stability and chelation, sodium hydroxide for alkalinity, chelating agents such as ethylenediaminetetraacetic acid (EDTA) and diethylenetriamine pentaacetic acid (DTPA) for control of heavy metals, and magnesium sulfate for cellulose stability. Each chemical added increases the cost of the bleaching method.

Although the benefits of using a chelant are known in the pulp and paper industry, the known chelants used in hydrogen peroxide bleaching:

(1) are usually selective in regards of the target transition metal ions (e.g., removing manganese but not iron or vice versa);

(2) must be applied in substantial quantities to achieve a noticeable effect; and (3) require washing out complexes formed during the treatment.

Selectivity can be defined as the ratio of the change in delignification (kappa number that characterizes lignin removal; the lower the better) divided by the change in viscosity (that characterizes carbohydrate depolymerization, the higher the better). Currently, the commonly used chemical for increasing the selectivity of oxygen delignification is magnesium sulfate. Magnesium sulfate does not influence the delignification, but provides a small measure of protection for the pulp viscosity. Conventional chelants such as DTPA and EDTA are also used for this purpose, however, none of them are reported to affect the kappa number. Therefore, currently, there are no known additives that can provide a noticeable improvement in lignin removal during oxygen delignification.

Japanese Patent Application No. 4-114853 discloses a method of pretreatment of wood pulp before bleaching which uses certain water-soluble polymers. The desired goal is to subject wood pulp to bleaching pretreatment through inexpensive pretreatment having little toxicity, thereby permitting a high degree of bleaching of wood pulp in the subsequent bleaching step. The recommended amount of polymer used in this Japanese Patent Application is from about 0.04 to 0.8 wt % per "exsiccated" pulp.

It would be desirable to identify additional or alternative compounds capable of enhancing the brightening of pulp in Chemical and Mechanical Pulping processes; or to be capable of enhancing delignification of pulp in Chemical Pulping processes.

SUMMARY OF THE INVENTION

The first aspect of the instant claimed invention is, in a method for making Chemical pulp comprising the steps of digesting wood chips in the digester to create unbleached pulp and then bleaching the pulp and optionally subjecting the pulp to pressurized oxygen delignification; the improvement comprising treating the pulp with from about 0.002 weight % to about 0.02 weight % of an organic sulfide chelating agent before or during bleaching, or before optional oxygen delignification of the pulp.

The second aspect of the instant claimed invention is in a method for making Mechanical pulp comprising the steps of grinding or refining wood to create unbleached pulp and then bleaching the pulp; the improvement comprising treating the pulp with from about 0.002 weight % to about 0.02 weight % of an organic sulfide chelating agent before or during bleaching.

DETAILED DESCRIPTION OF THE INVENTION

Throughout this patent application, the following terms have the indicated meanings.

Aldrich refers to Aldrich, P.O. Box 2060, Milwaukee, Wis. 53201.

AMP refers to aminotris(methylenephosphonic acid).

CAS Registry Number is the Chemical Abstracts Services Registry Number.

CMP refers to ChemiMechanical Pulping.

$$\text{Consistency} = \frac{\text{wt. in grams of oven-dry fiber}}{\text{100 grams of pulp-water mixture}}$$

This definition of consistency is according to Tappi recommended procedure T240om-93.

Throughout this patent application, consistency is stated either as a decimal number or as the equivalent percentage.

CTMP refers to ChemiThermoMechanical Pulping.

DTPA refers to diethylenetriaminepentaacetic acid.

EDTA refers to ethylenediaminetetraacetic acid.

MgO refers to magnesium oxide.

Nalco refers to ONDEO Nalco Company, ONDEO Nalco Center, 1601 W. Diehl Road, Naperville, Ill. 60563, (630) 305-1000.

PAPEMP refers to polyaminopolyethermethylenephosphonate.

PGW refers to Pressurized GroundWood pulp.

RMP refers to Refiner Mechanical Pulp.

SCMP refers to SemiChemical Mechanical Pulping.

SGW refers to Stone GroundWood pulp.

TDA refers to tridecylalcohol.

TMP refers to Thermo Mechanical Pulping.

TRMP refers to Thermo Refiner Mechanical Pulping.

Weight % means weight of active ingredient per weight of dry pulp.

The first aspect of the instant claimed invention is in a method for making Chemical pulp comprising the steps of digesting wood chips in the digester to create unbleached pulp and then bleaching the pulp and optionally subjecting the pulp to pressurized oxygen delignification; the improvement comprising treating the pulp with an organic sulfide chelating agent either before or during bleaching or before oxygen delignification of the pulp.

The Chemical pulp can be one of several types including kraft, sulfite, chemimechanical and ChemiThermoMechanical Pulp.

The method is comprised of treating the Chemical or Mechanical pulp with an organic sulfide chelant selected from the group consisting of monomeric dithiocarbamates, polymeric dithiocarbamates, polydiallylamine dithiocarbamates, 2,4,6-trimercapto-1,3,5-triazine, thiocarboxylic acid, thioglycolic acid, sodium trithiocarbonate, mercaptoquinazolinone, mercatopyridine, mercatopyrimidine, thiolactic acid, mercaptoethanol, mercaptopropanol, 2,3-dimercaptopropanol, thioglycerol, oxydiethanethiol, disodium ethylenebisdithiocarbamate, dithiothreitol, benzenethiol, mercaptoimidazole, mercaptobenzimidazole, mercaptotriazole, mercaptotetrazole and salts thereof and mixtures thereof.

Thioglycolic acid is available from Aldrich.

Thiolactic acid is available from Aldrich.

Mercaptoethanol and mercaptopropanol are available from Aldrich 2,3-dimercaptopropanol is available from Aldrich.

Thioglycerol is available from Aldrich.

Dithiothreitol is available from Aldrich.

Thiophenols are available from Aldrich.

Mercaptoimidazole is available from Aldrich.

Mercaptobenzimidazole is available from Aldrich.

Mercaptotriazole is available from Aldrich.

Mercaptotetrazole is available from Aldrich.

Mercaptoquinazolininone is available from Aldrich.

Mercaptopyridine is available from Aldrich.

Mercaptopyrimidine is available from Aldrich.

Mercaptothiazoline is available from Aldrich.

Disodium ethylenebisdithiocarbamate is available from Alco Chemical of Chattanooga of Tennessee. 2,4,6-Trimercapto-1,3,5-triazine trisodium salt is available from Degussa-Huls AG of Germany.

Polydiallylamine dithiocarbamates useful in the instant claimed invention are water-soluble polymers of Formula A:

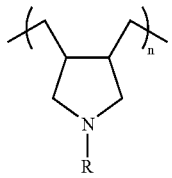

wherein R is H or $CS^{-}_{2}$ $X^{+}$ and $X^{+}$ is an alkali metal (such as sodium or potassium), an alkaline earth metal or ammonium, and n is the number of repeating units such that the polymer has a total molecular weight in the range of from about 3000 to about 100,000. Polymers of Formula A are described and claimed in U.S. patent application Ser. No. 09/638,434, filed Aug. 14, 2000, entitled, "Water Soluble Polymer Containing Dithiocarbamate Functionalities" by William S. Ward. U.S. patent application Ser. No. 09/638,434 is incorporated by reference in its entirety.

Monomeric dithiocarbamates and polymeric dithiocarbamates are known to people of ordinary skill in the art. They can be synthesized and some of them are available commercially from Nalco.

The preferred organic sulfide chelants for use in the method of the instant claimed invention are monomeric dithiocarbamates and polymeric dithiocarbamates.

Preferable monomeric dithiocarbamates are of Formula I and Formula II.

I

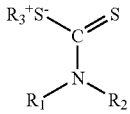

II

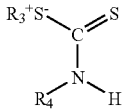

In Formula I, $R_1$ and $R_2$ can be the same or different and are selected from the group consisting of methyl, ethyl and propyl. $R_3$ is a positive metal cation selected from the group consisting of sodium and potassium.

In Formula II, $R_4$ is selected from the group consisting of methyl, ethyl and propyl. $R_3$ is positive metal cation selected from the group consisting of sodium and potassium.

Most preferred monomeric dithiocarbamates of Formula II and Formula I are:

Carbamodithioic acid, methyl-, monosodium salt, CAS Reg. No. 137-42-8;

Carbamodithioic acid, methyl-, monopotassium salt, CAS Reg. No. 137-41-7;

Carbamodithioic acid, ethyl-, monosodium salt, CAS Reg. No. 13036-87-8;

Carbamodithioic acid, ethyl-, monopotassium salt, CAS Reg. No. 63467-57-2;

Carbamodithioic acid, propyl-, monosodium salt, CAS Reg. No.20562-43-0;

Carbamodithioic acid, propyl-, monopotassium salt, CAS Reg. No. 135261-18-6;

Carbamodithioic acid, (1-methylethyl)-, monosodium salt, CAS Reg. No. 38457-16-8;

Carbamodithioic acid, (1-methylethyl)-, monopotassium salt, CAS Reg. No. 172539-30-9;

Carbamodithioic acid, dimethyl-, sodium salt, CAS Reg. No. 128-04-1;

Carbamodithioic acid, dimethyl-, potassium salt, CAS Reg. No. 128-03-0;

Carbamodithioic acid, diethyl-, sodium salt, CAS Reg. No. 148-18-5;

Carbamodithioic acid, diethyl-, potassium salt, CAS Reg. No.3699-30-7;

Carbamodithioic acid, dipropyl-, sodium salt, CAS Reg. No. 4143-50-4;

Carbamodithioic acid, dipropyl-, potassium salt, CAS Reg. No. 3699-31-8;

Carbamodithioic acid, bis(1-methylethyl)-, potassium salt, CAS Reg. No. 3803-98-3; and Carbamodithioic acid, bis(1-methylethyl)-, sodium salt, CAS Reg. No. 4092-82-4.

The compounds of Formula I and Formula II are either available commercially or are capable of being synthesized according to techniques known to persons of ordinary skill in the art. Certain of the compounds of Formula I and Formula II are available from NALCO under the names Nalmet®8154 and Nalco® 7614.

Preferable polymeric dithiocarbamates are of Formula III(polymeric saturated amine modified with carbon disulfide such that about 30 mole % dithiocarbamate salt groups are formed) and Formula IV (polymeric saturated amine modified with carbon disulfide such that about 50 mole % dithiocarbamate salt groups are formed).

III

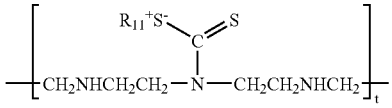

IV

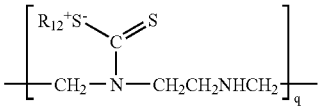

In Formula III, t is an integer from 2 to 45. $R_{11}$ is a positive metal cation selected from the group consisting of sodium and potassium.

In Formula IV, q is an integer from 3 to 55. $R_{12}$ is a positive metal cation selected from the group consisting of sodium and potassium.

Preferred polymeric dithiocarbamates of Formula III and IV have a weight average molecular weight of between about 500 and about 100,000.

Most Preferred polymeric dithiocarbamates of Formula III and Formula IV are available from NALCO under the names Nalmet® 8702 and Nalmet® 1689 respectively.

The amount of organic sulfide chelant added is from about 0.002% to about 0.02% by weight based on the total dry weight of the pulp, preferably from about 0.004% to about 0.008% by weight based on the total dry weight of the pulp, most preferably about 0.005% based on the total dry weight of the pulp.

It has been found that when an organic sulfide chelant is added to either a Chemical pulp or a Mechanical pulp before or during bleaching that brightness after bleaching is increased. Brightness is a term used to describe the whiteness of pulp on a scale: from 0%, meaning absolute black to 100%, relative to MgO standard, which has an absolute brightness of ca. 96%; by the reflectance of blue light (457 mm) from the paper produced from the pulp.

The unexpected finding of the instant claimed invention is that using less, (≦about 0.02 weight %) of the organic sulfide chelant is preferable to using more. This is in contrast to the teachings of the Japanese Patent Application No. 4-114853 which recommends using a minimum of 0.04 weight % of the polymer.

It has also been found that when the organic sulfide chelant is used, that it is also possible to further enhance the brightness by the use of an optional additional chelant, an optional surfactant, and optionally polyacrylic acid.

The additional chelants are selected from the group consisting of organic phosphonates.

These organic phosphonates are known to people of ordinary skill in the art of pulp and papermaking.

The surfactant is selected from the group consisting of alkanol alcoxy sulfates, preferably sodium laurylether (tris-ethyleneoxy) sulfate. This compound is available commercially. Polyacrylic acid is available from Nalco as Nalco® PR-4512.

The amount of additional chelant used is known to people of ordinary skill in the art of pulp making.

The amount of surfactant used is known to people of ordinary skill in the art of pulp making.

The amount of polyacrylic acid used is known to people of ordinary skill in the art of pulp making.

The additional chelant or surfactant or polyacrylic acid is added before or contemporaneously with the organic sulfide chelant agent.

Optionally, Chemical pulps are subjected to pressurized oxygen delignification before or during the overall bleaching process. Pressurized oxygen delignification takes place using a liquor containing sodium hydroxide with pressurized oxygen. In a preferred version of this embodiment, the liquor includes an additive such as an organic phosphonate and/or a surfactant.

Delignification is also known as "lignin removal" and is characterized by the kappa number of the pulp. The kappa number of the pulp is the volume, usually reported in ml of 0.1N potassium permanganate solution consumed by one gram of moisture-free pulp under the conditions specified in TAPPI Method T236om-99. The kappa number is linearly proportional to the amount of residual lignin in the pulp. The Pulp viscosity is determined by the capillary viscometer method, TAPPI Method T23om-99.

It has been found that when an organic sulfide chelant is added to a Chemical pulp prior to pressurized oxygen delignification, that the delignification is enhanced. The same organic sulfide chelants useful in improving brightness are useful in enhancing oxygen delignification. It is also true that the same amount of organic sulfide chelant is used to enhance oxygen delignification as is used to enhance brightness.

The second aspect of the instant claimed invention is in a method for making Mechanical pulp comprising the steps of grinding or refining wood to create unbleached pulp and then bleaching the pulp; the improvement comprising treating the pulp with an organic sulfide chelating agent either before bleaching, or during bleaching.

The Mechanical pulp can be one of several types including Stone GroundWood and Pressurized GroundWood pulp, RMP, TMP and TRMP.

Organic sulfide chelants suitable for use in this second aspect of the instant claimed invention are the same as those listed for use in the first aspect of the instant claimed invention. The preferred organic sulfide chelants for use in Mechanical pulps are Nalmet® 8702 and Nalmet® 8154.

The amount of organic sulfide chelant added is from about 0.002% to about 0.02% by weight based on the total dry weight of the pulp, preferably from about 0.004% to about 0.008% by weight based on the total dry weight of the pulp, most preferably about 0.005% based on the total dry weight of the pulp.

As was stated previously, it has been found that when an organic sulfide chelant is added to a Mechanical Pulp that brightness after bleaching is increased.

The following examples are intended to be illustrative of the present invention and to teach one of ordinary skill how to make and use the invention. These examples are not intended to limit the invention or its protection in any way.

EXAMPLES

In all of these Tables, the dosages of the applied chemicals are calculated based on the weights of an active ingredient (dry) and O.D. pulp.

For these Examples, the Test Protocol was:

A 53.5-g (dry weight 10 g) sample of pulp was placed in a plastic bag and thoroughly mixed with a solution of the treatment chemical in water at 10% consistency. As stated previously, $$\text{Consistency} = \frac{\text{wt. in grams of oven-dry fiber}}{\text{100 grams of pulp-water mixture}}$$

The bag was sealed and kept in a water bath at 40° C. for 30 minutes (unless specified otherwise). The sample was mixed with more water to 5% consistency. When the experiment continued (1-10 minutes later) the excess of water was filtered out on a Buchner funnel under reduced pressure, the pulp weighed to determine the consistency and used in the subsequent bleaching experiment. The same procedure was also applied at 2% consistency followed by dewatering only.

The control sample was treated in accordance with the same procedure only without the treatment chemical.

Hydrogen Peroxide Bleaching

The bleaching was conducted at 10% consistency. A solution of the bleaching additive in 2.5 ml water was added to 45 ml water (plus any additional water necessary to compensate for the loss of water after treatment). Subsequently, solutions of sodium hydroxide (30 g/L, usually 1% to dry pulp), magnesium sulfate (10 g/L, 0.05% to dry pulp), and hydrogen peroxide (30 g/L, usually 1.5% in the prepared mixture) were added under stirring. The bleaching solution was immediately thoroughly mixed with the pulp in a plastic bag and the pH measured. The bag was sealed and kept in a water bath at 70° C. for 1 hour and 30 minutes (unless specified otherwise).

After the bleaching, the solution was filtered and pH and the residual hydrogen peroxide content were measured. The pulp was then mixed with water at pH 6 to a 0.5% consistency until a homogeneous slurry was formed. The slurry was filtered on a Buchner funnel under reduced pressure to form a handsheet. The handsheet was dewatered under pressure and dried overnight in a constant humidity chamber at 23° C. and 50% relative humididty.

Hydrosulfite Bleaching

The bleaching was conducted at 10% consistency. A solution of the bleaching additive in 2.5 ml water was added to 45 ml (plus any additional water necessary to compensate for the loss of water after treatment). Subsequently, a solution of sodium hydrosulfite (30 g/L, 85% active, 1% to dry pulp) was added under stirring. The bleaching solution was immediately thoroughly mixed with the pulp in a plastic bag and the pH measured. The bag was sealed and kept in a water bath at 70° C. for 1 hour and 30 minutes.

After the bleaching, the solution was filtered and the pulp was then mixed with water at pH 6 and 0.5% consistency until a homogeneous slurry was formed. The slurry was filtered on a Buchner funnel under reduced pressure to form a handsheet. The handsheet was dewatered under pressure and dried overnight in a constant humidity room.

Oxygen Delignification

The delignification was conducted at 5% consistency. The pulp, after treatment, was thoroughly mixed with a solution containing sodium hydroxide (2.5% to dry pulp) and, optionally, the additive (0.05% to dry pulp) and placed in a Parr reactor. The mixture was pressurized with oxygen at 100 psi. The reactor was closed and delignification conducted under stirring at 96° C. for 1-2 hours.

After the reaction, the reactor was cooled down to room temperature and depressurized. The pulp was washed at 0.5% consistency at pH 6 and dewatered. The dry content, kappa number and viscosity were determined for each sample. In a control sample, magnesium sulfate (0.05% to dry pulp) was added to the sodium hydroxide solution before delignifications.

Assessment of the Effectiveness

The ISO (%) brightness (R457; TAPPI Method T525 om-92) and yellowness (E313) were measured on an Elrepho-3000 instrument (Datacolor International, Charlotte, N.C.) with a margin of error of ±0.05.

EXAMPLE 1 through Example 7

Hydrogen Peroxide Bleaching Results

Tables 1-7 present the results of hydrogen peroxide bleaching experiments (1% NaOH, 1.5% $H_2O_2$, 1 hour and 30 minutes, unless specified otherwise; actives-based dosages). Commercial sodium silicate (grade 40, 38.25% solids, available from Occidental Chemical Corporation, Dallas, Tex.), EDTA and DTPA (available from The Dow Chemical Company, Midland, Mich.) were used as comparative examples.

The following parameters were used to assess the changes in brightness:

R457Br=brightness as described above.

E313Ye=yellowness as described above.

In each presented figure or table, the comparisons are made in the same series (8-10 samples).

TABLE 1

Hydrogen Peroxide Bleaching of TMP after treatment with Nalmet ® 8702 in Tap Water

| Sample | Treatment | Bleaching Additive | R487Br | E313Ye |
|---|---|---|---|---|
| 1 | None (comparative example) | None | 68.32 | 17.98 |
| 2 | None (comparative example) | $NaBO_2$ 1.5% | 68.39 | 17.64 |
| 3 | 0.02% | $NaBO_2$ 1.5% | 70.59 | 17.26 |
| 4 | 0.008% | $NaBO_2$ 1.5% | 70.75 | 17.09 |
| 5 | 0.02% | $NaBO_2$ 1.5% + AMP 0.15% | 71.29 | 17.17 |
| 6 | 0.02% | $NaBO_2$ 1.5% + AMP 0.015% | 71.18 | 16.84 |
| 7 | 0.02% | $NaBO_2$ 1.5% – NaOH 0.5% | 69.63 | 17.66 |
| 8 | 0.02% | $NaBO_2$ 2% – NaOH 0.5% | 70.69 | 17.12 |
| 9 | 0.02% | $NaBO_2$ 2% – NaOH 0.25% | 69.89 | 17.62 |
| 10 | None (comparative example) | Sodium silicate grade 40, 2% | 71.08 | 16.81 |

Table 1 shows that combining a organic sulfide chelant treatment with application of sodium metaborate and an organic phosphonate chelant on the bleaching stage outperforms sodium silicate at 2% load (it was shown in a separate experiment that further increasing the load of the silicate has a detrimental effect of brightness). It can also be seen that sodium metaborate alone does not produce any noticeable effect and that a change in the dose of the organic phosphonate from 0.15% to 0.015% has little (and also beneficial in regards to yellowness) effect. Most importantly it was found that that a decrease in the dose of the polymeric dithiocarbamate from 0.02% to 0.008% has in fact a beneficial effect.

EXAMPLE 2

TABLE 2

Hydrogen Peroxide Bleaching of TMP after treatment with Polymeric Dithiocarbamate Nalmet ® 8702 in Tap Water

| Sample | Treatment | Bleaching Additive | R487Br | E313Ye |
|---|---|---|---|---|
| 1 | None (comparative example) | None | 70.04 | 17.63 |
| 2 | 0.008% | $NaBO_2$ 1.5% | 71.78 | 17.36 |
| 3 | 0.004% | $NaBO_2$ 1.5% | 71.72 | 17.42 |
| 4 | 0.02% | None | 71.55 | 17.33 |
| 5 | 0.008% | None | 71.39 | 17.3 |
| 6 | 0.008% | AMP 0.015% | 71.65 | 17.35 |
| 7 | 0.008% | AMP 0.015% + $NaBO_2$ 1.5% | 72.22 | 17.3 |
| 8 | 0.004% | AMP 0.015% | 71.49 | 17.43 |
| 9 | 0.02% | AMP 0.15% | 72.1 | 17.25 |
| 10 | None (comparative example) | Sodium silicate grade 40, 2% | 71.94 | 17.27 |

Table 2 shows that a treatment with polymeric dithiocarbamate can be effective at very low doses (up to about 0.02% by weight). Again, combining such treatment with subsequent applications of an organic phosphonate alone, or at lower doses, with sodium metaborate results in greater brightness than that achieved with sodium silicate.

EXAMPLE 3

TABLE 3

Hydrogen Peroxide Bleaching of TMP after Treatment with Polymeric Dithiocarbamate Nalmet ® 8702 in Tap Water

| Sample | Treatment | Bleaching Additive | R487Br | E313Ye |
|---|---|---|---|---|
| 1 | None (comparative example) | None | 70.24 | 17.77 |
| 2 | 0.02% | $NaBO_2$ 1.5% | 72.49 | 17.09 |
| 3 | 0.02% | $NaBO_2$ 1.5% + PAPEMP 0.16% | 72.89 | 17.05 |
| 4 | 0.02% | $NaBO_2$ 1.5% + PAPEMP 0.016% | 72.3 | 17.44 |
| 5 | 0.02% | $NaBO_2$ 1.5% + Sodium hexametaphosphate 0.05% | 72.37 | 17.49 |
| 6 | 0.02% | $NaBO_2$ 1.5% + Sodium hexametaphosphate 0.1% | 72.46 | 17.43 |
| 7 | None (comparative example) | Sodium silicate grade 40, 2% | 72.42 | 17.17 |

Table 3 shows that treatment with a polymeric dithiocarbamate can be combined with different phosphonate on the bleaching stage. The data also clearly demonstrates that phosphonates, but not inorganic polyphosphate, are effective on the bleaching stage.

EXAMPLE 4 (Comparative Example—Not an Example of the Instant Claimed Invention)

TABLE 4

Hydrogen Peroxide Bleaching of TMP without Treatment in Deionized Water (dry weight-based dosages): 1.5% NaOH, 2% $H_2O_2$

| Sample | Bleaching Additive | R487Br | E313Ye |
|---|---|---|---|
| 1 | None | 70.43 | 17.81 |
| 2 | 0.16% PAPEMP, 1% $NaBO_2$ | 71.31 | 17.6 |
| 3 | 0.16% PAPEMP, 1.5% $NaBO_2$ | 71.61 | 17.42 |
| 4 | 0.16% PAPEMP, 1% $NaBO_2$, 0.5% pinacol* | 70.91 | 17.87 |
| 5 | 0.16% PAPEMP, 2% $NaBO_2$, 0.5% pinacol* | 71.65 | 17.62 |
| 6 | 0.16% PAPEMP, 1% $NaBO_2$, 0.5% sodium acetate | 71.46 | 17.63 |
| | 0.26% DTPA | 71.3 | 17.57 |
| 7 | Sodium silicate grade 40, 2% | 72.49 | 16.32 |

*2,3-Dimethyl-2,3-butanediol, available from Aldrich.

Table 4 shows the effect of hydrogen peroxide activators and chelants on brightness without a pretreatment. The effect is significantly less pronounced than when the treatment is involved.

EXAMPLE 5 through Example 7

TABLE 5

Hydrogen Peroxide Bleaching of GWD: 1.5% $H_2O_2$, 1% NaOH, 0.05% $MgSO_4$, Tap Water

| Sample | Treatment | Bleaching Additive | R487Br | E313Ye |
|---|---|---|---|---|
| 1 | None (comparative example) | None | 71.76 | 16.38 |

TABLE 5-continued

Hydrogen Peroxide Bleaching of GWD: 1.5% $H_2O_2$, 1% NaOH, 0.05% $MgSO_4$, Tap Water

| Sample | Treatment | Bleaching Additive | R487Br | E313Ye |
|---|---|---|---|---|
| 2 | None (comparative example) | 2% Sodium silicate, grade 40 | 72.55 | 16.37 |
| 3 | 0.008% Nalmet ® 1689 | 0.015% AMP; 1.5% $NaBO_2$ | 72.11 | 16.71 |
| 4 | 0.008% Nalmet ® 1689 | 0.15% AMP | 72.23 | 16.68 |
| 5 | 0.008% Nalmet ® 1689 | 0.015% AMP | 72.1 | 16.7 |
| 6 | 0.008% Nalmet ® 8702 | 0.015% AMP; 1.5% $NaBO_2$ | 72.55 | 16.72 |

TABLE 6

Hydrogen Peroxide Bleaching of GWD: 0.5% $H_2O_2$, 1% NaOH, 0.05% $MgSO_4$, Tap Water

| Sample | Treatment | Bleaching Additive | R487Br | E313Ye |
|---|---|---|---|---|
| 1 | None (comparative example) | Control | 64.17 | 19.48 |
| 2 | None (comparative example) | 0.26% DTPA | 64.82 | 19.31 |
| 3 | 0.008% Nalmet ® 1689 | None | 65.26 | 19.04 |
| 4 | 0.008% Nalmet ® 1689 | 0.015% AMP | 65.42 | 19.02 |
| 5 | 0.008% Nalmet ® 8702 | None | 65.16 | 19.1 |
| 6 | 0.008% Nalmet ® 8702 | 0.015% AMP | 65.4 | 19.36 |

TABLE 7

Hydrogen Peroxide Bleaching of Pressed GWD (Aspen): 1% $H_2O_2$, 1% NaOH, Tap Water, 60 minutes; De-water only (2% consistency treatment)

| Sample | Treatment | Bleaching Additive | R487Br | E313Ye |
|---|---|---|---|---|
| 1 | None (comparative example) | None | 69.7 | 16.44 |
| 2 | None (comparative example) | 0.1% EDTA | 70.76 | 15.85 |
| 3 | 0.008% Nalmet ® 8702 | None | 71.11 | 15.86 |
| 4 | 0.004% Nalmet ® 8702 | None | 71.07 | 15.93 |
| 5 | 0.002% Polydiallylamine dithiocarbamate[α] | None | 71.11 | 15.9 |
| 6 | 0.008% Polydiallylamine dithiocarbamate[α] | None | 71.62 | 15.71 |
| 7 | 0.004% Polydiallylamine dithiocarbamate[α] | None | 71.55 | 15.73 |
| 8 | 0.008% Polydiallylamine dithiocarbamate[α] | 0.015% AMP | 72.25 | 15.42 |

[α]This polydiallylamine dithiocarbamate is of Formula A where R is $CS^-_2X^+$ and $X^+$ is sodium.

Tables 5-7 show that the method can be successfully applied to groundwood of different origin. Table 7 shows that the treatment at low consistency with subsequent dewatering is an effective method to increase brightness.

EXAMPLE 8 and Example 9

Hydrosulfite Bleaching Results

Tables 8 and 9 show the results of hydrosulfite bleaching experiments in tap water for 1 hour 30 minutes where commercial EDTA was used as the comparative example.

The tables show that treatment with polymeric dithiocarbamates or trimercaptotriazine alone results in an increase in brightness comparable to that achieved with the application of EDTA. This effect is observed when the proposed chemicals are applied in concentrations at least ten times lower than those of EDTA. Additional application of an organic phosphonate chelant on the bleaching stage allows for the outperforming of EDTA. The dosages of applied chemicals are much lower than those of conventional additives.

TABLE 8

Hydrosulfite Bleaching of Pressed GWD (Aspen): 1% Sodium Hydrosulfite

| Sample | Treatment | Bleaching Additive | R487Br | E313Ye |
|---|---|---|---|---|
| 1 | None (comparative example) | None | 67.7 | 17.13 |
| 2 | None (comparative example) | 0.1% EDTA | 69.94 | 16.31 |
| 3 | 0.008% Nalmet ® 8702 | None | 69.97 | 15.94 |
| 4 | 0.008% Nalmet ® 8702 | 0.015% AMP | 69.96 | 15.93 |
| 5 | 0.01% Trimercaptotriazine | None | 69.96 | 15.94 |
| 6 | 0.01% Trimercaptotriazine | 0.015% AMP | 70.39 | 15.74 |

TABLE 9

Hydrosulfite Bleaching of TMP (Spruce): 1.5% Sodium Hydrosulfite

| Sample | Treatment | Bleaching Additive | R487Br | E313Ye |
|---|---|---|---|---|
| 1 | None (comparative example) | None | 59.99 | 22.66 |
| 2 | None (comparative example) | 0.1% EDTA | 60.7 | 22.52 |
| 3 | 0.004% Nalmet ® 1689 | None | 60.63 | 21.88 |
| 4 | 0.008% Nalmet ® 1689 | None | 59.93 | 22.23 |
| 5 | 0.004% Nalmet ® 8702 | None | 60.87 | 21.74 |
| 6 | 0.008% Nalmet ® 8702 | None | 60.91 | 21.81 |

EXAMPLE 10 and Example 11

TABLE 10

Hydrosulfite Bleaching of TMP (Spruce): 1.5% Sodium Hydrosulfite, (no washing after the treatment; sodium hydrosulfite added as 10 ml of 15 g/L solution)

| Sample | Treatment | Bleaching Additive | Time of treatment, min | R487Br | E313Ye |
|---|---|---|---|---|---|
| 1 | None (comparative example) | None | 20 | 57.99 | 23.43 |
| 2 | None (comparative example) | 0.1% EDTA | 20 | 58.21 | 23.6 |
| 3 | 0.004% Nalmet ® 8702 | None | 5 | 58.35 | 23.45 |
| 4 | 0.004% Nalmet ® 8702 | None | 10 | 58.5 | 23.25 |
| 5 | 0.004% Nalmet ® 8702 | None | 20 | 58.34 | 23.22 |
| 6 | 0.004% Nalmet ® 8702 | None | 30 | 58.16 | 23.38 |

TABLE 10-continued

Hydrosulfite Bleaching of TMP (Spruce): 1.5% Sodium Hydrosulfite, (no washing after the treatment; sodium hydrosulfite added as 10 ml of 15 g/L solution)

| Sample | Treatment | Bleaching Additive | Time of treat-ment, min | R487Br | E313Ye |
|---|---|---|---|---|---|
| 7 | 0.004% Nalmet ® 1689 | None | 10 | 58.07 | 23.47 |
| 8 | 0.004% Nalmet ® 1689 | None | 30 | 58.3 | 23.5 |

TABLE 11

Hydrosulfite Bleaching of TMP (Spruce): 1.5% Sodium Hydrosulfite, (2% consistency treatment; sodium hydrosulfite added as 5 ml of 30 g/L solution)

| Sample | Treatment | Bleaching Additive | Time of treat-ment, min | R487Br | E313Ye |
|---|---|---|---|---|---|
| 1 | None (comparative example) | None | 20 | 59.73 | 22.29 |
| 2 | None (comparative example) | 0.1% EDTA | 20 | 60.22 | 22.63 |
| 3 | 0.004% Nalmet ® 8702 | None | 5 | 60.47 | 21.79 |
| 4 | 0.004% Nalmet ® 8702 | None | 10 | 60.16 | 21.9 |
| 5 | 0.004% Nalmet ® 8702 | None | 20 | 62.34 | 21.09 |
| 6 | 0.004% Nalmet ® 8702 | None | 30 | 61.09 | 21.65 |
| 7 | 0.004% Nalmet ® 1689 | None | 10 | 62.26 | 21.07 |
| 8 | 0.004% Nalmet ® 1689 | None | 30 | 60.39 | 21.81 |

Tables 10 and 11 show the effects of treatment time and washing on the brightness of the pre-treated pulp after bleaching.

EXAMPLE 12

TABLE 12

Delignification of three different types of softwood kraft pulp in tap water

| Pulp | Treatment | Delignification Additive | Kappa # | Viscosity | Time of Experiment |
|---|---|---|---|---|---|
| Kraft, laboratory | None(comparative example) | None | 17.5 | 15.7 | 1 h 17 min |
| | Nalmet ® 8702 0.008% | None | 15 | 15.9 | 1 h 17 min |
| Kraft, 2 yr. Old | None(comparative example) | None | 20.9 | 21.7 | 1.5 h |
| | Nalmet ® 8702 0.008% | None | 20 | 23.6 | 1.5 h |
| Kraft, 2 yr. Old | None(comparative example) | None | 19.7 | 20.3 | 2 h |
| | Nalmet ® 8702 0.008% | None | 17.4 | 20.9 | 2 h |
| Kraft, new | None(comparative example) | None | 20 | 20.2 | 1.5 h |
| | Nalmet ® 8702 0.008% | None | 18.3 | 20.7 | 1.5 h |
| | Nalmet ® 8702 0.008% | TDA 0.05% | 17.2 | 20.7 | 1.5 h |

Table 12 shows the results of delignification experiments in tap water on three different types of kraft pulp. It can be seen that the treatment significantly reduces the kappa number leaving the viscosity on the same or even higher level. This brings about an improvement in the selectivity. Combining the treatment with the application of a surfactant results in further improvements in delignification.

EXAMPLE 13

Table 13 shows the effect of application of a polymeric organic sulfide chelant (Nalmet® 8702) in a combination with a chelant (AMP) or a surfactant (an ethoxy sulfate, available from Nalco as Nalco® 1PM020) and an organic sulfide chelant (Nalmet® 8154) with a chelant (AMP) or with a polyacrylic acid (Nalco® PR-4512). The surfactant was applied after the organic sulfide chelant and then the pulp was bleached.

TABLE 13

Hydrogen Peroxide Bleaching of GWD Poplar 55%/TMP Spruce 45%: 1% $H_2O_2$, 1% NaOH, No $MgSO_4$, Tap Water, 60 minutes

| Sample | 2% Pre-treatment | Bleaching Additive | R487Br | E313Ye |
|---|---|---|---|---|
| 1 | Comparative example | None | 60.95 | 21.58 |
| 2 | Comparative example | 0.1% DTPA | 63.12 | 21.1 |
| 3 | 0.008% Nalmet ® 8702 | None | 61.33 | 21.46 |
| 4 | 0.008% Nalmet ® 8702 and 0.015% AMP | None | 61.47 | 21.44 |
| 5 | 0.008% Nalmet ® 8702 and 0.011% Nalco ® PR-4512 | None | 61.75 | 21.12 |
| 6 | 0.008% Nalmet ® 8702 and 0.014% Nalco ® 1PM020 | None | 62.13 | 21.16 |
| 7 | 0.008% Nalmet ® 8154 | None | 61.87 | 21.15 |
| 8 | 0.008% Nalmet ® 8154 and 0.015% AMP | None | 62.13 | 21.24 |
| 9 | 0.008% Nalmet ® 8154 and 0.011% Nalco ® PR-4512 | None | 62.34 | 21.03 |

EXAMPLE 14

Table 14 gives an example of the effect of an organic sulfide chelant (Nalmet® 8154) alone and in a combination with polyacrylic acid (Nalco® PR-4512) on the end brightness of kraft pulp. The effect is significant and does not depend on the way of application of the treatment chemicals: it remains almost the same with and without dewatering. The combination of organic sulfide chelant and polyacrylic acid outperforms DTPA.

TABLE 14

Hydrogen Peroxide Bleaching of Kraft Pulp (Unbleached): 3% $H_2O_2$, 1% NaOH, DI Water, 60 minutes #1–5: pre-treatment at 10%, no dewatering; #6–9: pre-treatment at 10%, dewatering (20 min pre-treatment)

| Sample | 2% Pre-treatment | Bleaching Additive | R487Br | E313Ye |
|---|---|---|---|---|
| 1 | Comparative example | None | 43.71 | 32.64 |
| 2 | Comparative example | 0.1% DTPA | 43.55 | 32.54 |
| 3 | 0.004% Nalmet ® 8154 | None | 43.84 | 32.56 |
| 4 | 0.008% Nalmet ® 8154 | None | 43.7 | 32.73 |
| 5 | 0.004% Nalmet ® 8154 and 0.006% Nalco ® PR-4512 | None | 44.72 | 32.39 |
| 6 | Comparative example | None | 45.49 | 31.7 |
| 7 | Comparative example | 0.1% DTPA | 45.88 | 31.83 |
| 8 | 0.008% Nalmet ® 8154 | None | 46.02 | 31.79 |
| 9 | 0.008% Nalmet ® 8154 and 0.006% Nalco ® PR-4512 | None | 46.26 | 31.54 |

EXAMPLE 15

Table 15 gives examples of combining a polymeric organic sulfide chelant (Nalmet® 8702) with a surfactant (an ethoxy sulfate, Nalco® 1PM020) and an organic sulfide chelant (Nalmet® 8154) with a polyacrylic acid (Nalco® PR-4512). The surfactant can be applied either during or after the pre-treatment. A combination of Nalmet® 8154 with Nalco PR-4512 gives the largest effect. It can be seen from the data that this is a result of a synergism because polyacrylic acid by itself does not provide significant improvement.

TABLE 15

Hydrosulfite Bleaching of GWD Poplar 55%/TMP Spruce 45%: 1.5% Sodium Hydrosulfite Tap Water, 60 minutes

| Sample | 2% Pre-treatment | Bleaching Additive | R487Br | E313Ye |
|---|---|---|---|---|
| 1 | comparative | None | 61.56 | 20.85 |
| 2 | comparative | 0.1% DTPA | 63.67 | 20.33 |
| 3* | 0.008% Nalmet ® 8702 and 0.014% Nalco ® 1PM020 | None | 62.22 | 20.22 |
| 4** | 0.008% Nalmet ® 8702 and 0.014% Nalco ® B-1PM020 | None | 62.19 | 20.38 |
| 5 | 0.008% Nalmet ® 8154 | None | 62.06 | 20.42 |
| 6 | 0.008% Nalmet ® 8154 and 0.006% Nalco ® PR-4512 | None | 62.64 | 20.19 |
| 7 | 0.006% Nalco ® PR-4512 | None | 61.86 | 20.45 |

*Surfactant applied during the pre-treatment
**Surfactant applied either after the pre-treatment While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

What is claimed is:

1. In a method for making Mechanical pulp comprising the steps of: grinding or refining wood to create unbleached pulp and then bleaching the pulp; the improvement comprising treating the pulp with from about 0.002 weight % to about 0.02 weight % of an organic sulfide chelating agent before bleaching; optionally adding an additional chelant; optionally adding a surfactant; and optionally adding polyacrylic acid.

2. In a method for making Mechanical pulp comprising the steps of: grinding or refining wood to create unbleached pulp and then bleaching the pulp; the improvement comprising treating the pulp with from about 0.002 weight % to about 0.02 weight % of an organic sulfide chelating agent before bleaching, wherein said organic sulfide chelant is selected from the group consisting of monomeric dithiocarbamates, polymeric dithiocarbamates, polydiallylamine dithiocarbamates, 2,4,6-trimercapto-1,3,5-triazine, thiocarboxylic acid, thioglycolic acid, sodium trithiocarbonate, mercaptoquinazolinone, mercaptopyridine, mercaptopyrimidine, thiolactic acid, mercaptoethanol, mercaptopropanol, 2,3-dimercaptopropanol, thioglycerol, oxydiethanethiol, disodium ethylenebisdithiocarbamate, dithiothreitol, benzenethiol, mercaptoimidazole, mercaptobenzimidazole, mercaptotriazole, mercaptotetrazole and salts thereof and mixtures thereof; optionally adding an additional chelant; optionally adding a surfactant; and optionally adding polacrylic acid.

3. The method of claim 1, wherein said bleaching occurs with a bleaching agent containing hydrosulfite.

4. The method of claim 1, wherein said bleaching occurs with a bleaching agent containing hydrogen peroxide.

* * * * *